US012698925B2

(12) United States Patent
Ahmed

(10) Patent No.: US 12,698,925 B2
(45) Date of Patent: Aug. 4, 2026

(54) THERMOELECTRIC SYSTEM CONSISTING OF ALTERNATING TRAPEZOID ELEMENTS WITH INCREASED FIGURE OF MERIT

(71) Applicant: Faizan Ahmed, San Jose, CA (US)

(72) Inventor: Faizan Ahmed, San Jose, CA (US)

( * ) Notice: Subject to any disclaimer, the term of this patent is extended or adjusted under 35 U.S.C. 154(b) by 85 days.

(21) Appl. No.: 18/398,134

(22) Filed: Dec. 27, 2023

(65) Prior Publication Data

US 2025/0216126 A1 Jul. 3, 2025

(51) Int. Cl.

| | |
|---|---|
| ***F25B 21/02*** | (2006.01) |
| ***F28D 15/02*** | (2006.01) |
| ***F28F 3/02*** | (2006.01) |

(52) U.S. Cl.

CPC ..... *F25B 21/02* (2013.01); *F28D 15/0233* (2013.01); *F28F 3/02* (2013.01)

(58) Field of Classification Search

CPC ..... F25B 21/00; F25B 21/02; F25B 21/04; F25B 2321/02; F25B 2321/023; H10N 10/17; H10N 10/80; H10N 10/82

See application file for complete search history.

(56) References Cited

U.S. PATENT DOCUMENTS 6,097,088 A * 8/2000 Sakuragi ..... C30B 29/46 257/467
6,226,994 B1 * 5/2001 Yamada ..... H10N 10/17 136/203
8,653,358 B2 * 2/2014 St. Rock ..... H10N 10/17 136/211
9,500,393 B2 * 11/2016 Anandhakrishnan ... F25B 21/02
11,641,779 B2 * 5/2023 Kasztelan ..... H10N 10/17 136/201
11,821,660 B2 * 11/2023 Zimmer ..... F25D 11/003
2015/0287901 A1 * 10/2015 Lorimer ..... H10N 10/17 136/200

FOREIGN PATENT DOCUMENTS

| | | | | |
|---|---|---|---|---|
| JP | H10190072 A * | 7/1998 | | |
| JP | 6839690 B2 * | 3/2021 | ..... | B33Y 80/00 |
| KR | 100989643 B1 * | 10/2010 | ..... | H10N 10/85 |
| KR | 20230073760 A * | 5/2023 | ..... | H10N 10/01 |
| WO | WO-2013124866 A2 * | 8/2013 | ..... | F25B 21/02 |

OTHER PUBLICATIONS

JP-H10190072-A English Translation (Year: 1998).*
JP-6839690-B2 English Translation (Year: 2021).*
KR-100989643-B1 English Translation (Year: 2010).*
KR-20230073760-A English Translation (Year: 2023).*
Axalta Coating Systems Plascoat® PPA 571 Proven Performance for Exterior Application (NPL-1) (Year: 2020).*

* cited by examiner

*Primary Examiner* — Frantz F Jules
*Assistant Examiner* — Devon Moore

(57) ABSTRACT

In one aspect, a thermo-electric system comprising alternating trapezoid elements with increased figure of merit comprises: a thermal spreader system comprising: a top plate comprising aluminum, and a bottom plate comprising aluminum; and an interior portion of the thermo-electric system comprising the alternating of trapezoid elements comprising a plurality of P-trapezoid elements and a plurality of N-trapezoid elements, wherein each P-trapezoid element alternates with an N-trapezoid element.

1 Claim, 7 Drawing Sheets

600

700 Portable refrigeration system
702 Portable refrigerator
704 Payload box / payload chamber
706 Payload
708 Sidewall of payload box
100 Thermo-electric system
710 Colder heat sink or heat exchanger
712 Heat transfer direction

THERMOELECTRIC SYSTEM CONSISTING OF ALTERNATING TRAPEZOID ELEMENTS WITH INCREASED FIGURE OF MERIT

CLAIM OF PRIORITY

This application claims priority to and is a continuation-in-part of and incorporates by reference U.S. Provisional application Ser. No. 18/374,646 titled THERMO-ELECTRIC SYSTEM COMPRISING CHAIN TRAPEZOID ELEMENTS WITH INCREASED FIGURE OF MERIT, and filed on Sep. 28, 2023. This application is incorporated by reference in its entirety.

U.S. patent application Ser. No. 18/374,646 claims priority to and incorporates by reference U.S. Provisional Application No. 63/411,096 METHOD AND SYSTEM OF A PORTABLE REFRIGERATOR and filed on Sep. 28, 2022. This application is incorporated by reference in its entirety.

U.S. patent application Ser. No. 18/374,646 claims priority to and is a continuation in part of and incorporates by reference in its entirety U.S. patent application Ser. No. 18/205,488, titled PORTABLE-SMART REFRIGERATOR METHODS AND SYSTEMS, and filed on 2 Jun. 2023.

U.S. patent application Ser. No. 18/205,488 claims priority to and incorporates by reference U.S. Provisional Application No. 63/348,484, titled PORTABLE-SMART REFRIGERATOR METHODS AND SYSTEMS, and filed on 2 Jun. 2022.

BACKGROUND

Field of the Invention

The invention is in the field of refrigeration and more specifically to a method, system and apparatus of a thermo-electric system comprising alternating trapezoid elements with increased figure of merit.

Description of the Related Art

Medicines and other products can degrade in certain conditions. For example, some temperatures need to be maintained in specified temperature ranges. Patients may not be able to constantly track medicine temperature. The same can be true for some testing instruments such as blood testing strips. Portable refrigerators can solve these issues. However, effective portable refrigerators need effective components that are sufficient. Accordingly, improvements to thermo-electric cooler pump design and use are desired.

BRIEF SUMMARY OF THE INVENTION

In one aspect, a thermo-electric system comprising alternating trapezoid elements with increased figure of merit comprises: a thermal spreader system comprising: a top plate comprising aluminum, and a bottom plate comprising aluminum; and an interior portion of the thermo-electric system comprising the chain of trapezoid elements comprising a plurality of P-trapezoid elements and a plurality of N-trapezoid elements, wherein each P-trapezoid element alternates with an N-trapezoid element.

Figure 1:
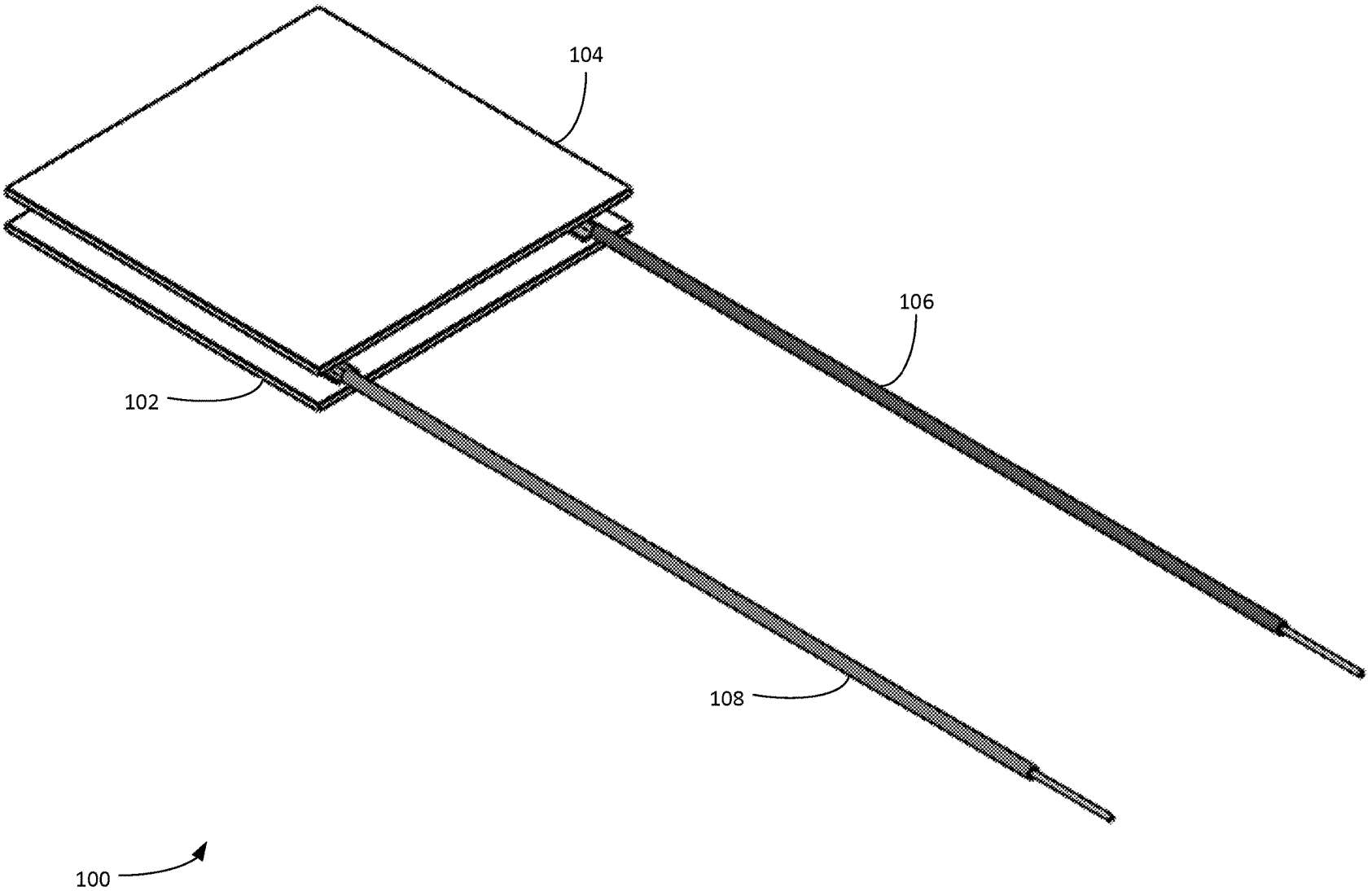
FIG. 1 illustrates an example view of a thermo-electric system comprising alternating trapezoid elements with increased figure of merit, according to some embodiments.

The Figures described above are a representative set and are not an exhaustive with respect to embodying the invention.

DESCRIPTION

Disclosed are a system, method, and article of manufacture for a thermo-electric system comprising alternating trapezoid elements with increased figure of merit. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment of the present invention. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Figure of merit (FOM) is a performance metric that characterizes the performance of a device, system, or method, relative to its alternatives. The thermoelectric figure of merit, zT, a material constant proportional to the efficiency of a thermoelectric couple made with the material.

Heat spreader transfers energy as heat from a hotter source to a colder heat sink or heat exchanger. There can be two thermodynamic types, passive and active. A passive heat spreader can be a plate or block of material having high thermal conductivity, such as copper, aluminum, or diamond. An active heat spreader speeds up heat transfer with expenditure of energy as work supplied by an external source.

Polyethylene glycol (PEG) is a polyether compound derived from petroleum with many applications, from industrial manufacturing to medicine. PEG is also known as polyethylene oxide (PEO) or polyoxyethylene (POE), depending on its molecular weight. The structure of PEG is commonly expressed as H—(O-CH2-CH2)n-OH.

Thermoelectric effect is the direct conversion of temperature differences to electric voltage and vice versa via a thermocouple. A thermoelectric device creates voltage when there are different temperatures on each side. Conversely, when a voltage is applied to it, heat is transferred from one side to the other, creating a temperature difference. At the atomic scale, an applied temperature gradient causes charge carriers in the material to diffuse from the hot side to the cold side. When an electric current is passed through a circuit of a thermocouple, heat is generated at one junction and absorbed at the other junction. This is known as the Peltier effect: the presence of heating or cooling at an electrified junction of two different conductors.

Example Thermo-Electric Cooler Pump System

FIG. 1 illustrates an example perspective view of a thermo-electric system 100 comprising alternating trapezoid elements with increased figure of merit, according to some embodiments. A thermoelectric system can be comprised of Polyethylene glycol. Polyethylene glycol has properties of heat absorption. Designed to have small trapezoid elements (e.g. see FIGS. 2-6 infra) built in alternating fashion. This allows for module to work in a way that the thermal conductivity between the two plates of the module is decreased and the electrical conductivity is increased hence increasing the Figure of Merit (FOM). FOM relates to increased efficiency such that less power is required to remove heat using this thermoelectric system.

The top plate 104 can be made of aluminum. The bottom plate 102 can also be made of aluminum. The bases of the trapezoid elements are broad with increased surface area in order to result in higher electrical conductivity (e.g. increase surface area of bottom of trapezoid increases area). Top plate 104 and bottom plate 102 can function as thermal spreaders.

Thermo-electric system 100 includes Negative Peltier wire 106 and Positive Peltier wire 108. These can be coupled with a various elements of a smart portable refrigerator.

When electrical conductivity is increased, more heat is absorbed. The elements can have the dimensions as shown in the figures per the example embodiments. These can be modified to result in increased efficiency and increase FOM. In some examples, the FOM equation utilized herein can be the electrical conductivity divided by the thermal conductivity. In this way, the lower the attributes of thermo-electric system 100 that decrease thermal conductivity lead to a higher FOM value. The attributes of thermo-electric system 100 that increase electrical conductivity lead to higher FOM value.

It is noted that present figures show units of measurement in millimeters.

In the context of a smart portable refrigerator, the present embodiments of a thermo-electric system comprising alternating trapezoid elements is attached to a cooling system (e.g. a smart portable refrigeration system as incorporated herein by reference in its entirety from 63/411,096 titled METHOD AND SYSTEM OF A PORTABLE REFRIGERATOR, and filed on Sep. 28, 2022 and 17693181 titled PORTABLE-SMART REFRIGERATOR METHODS AND SYSTEMS and filed on Mar. 11, 2022, etc.), it results in more heat being removed from the payload of the cooling device with a lower amount of power. In one example, system 100 can result in a payload of twelve (12) liters to reach 2° degrees Celsius in around three and half (3.5) hours. This results in quicker removal of heat from payload with a lower amount of power. Thermo-electric system 100 can be attached outside of a chamber of a smart portable refrigerator system (e.g. can be attached to a side of a payload container as a thermoelectric module, etc.). The payload box can be made of a compound mixture of aluminum and a cross-linked polymer in some examples. For example, the aluminum can be sprayed and/or mixed in with the cross-linked polymer (e.g. a thermoplastic elastomer, PEG, etc.).

Figure 2:
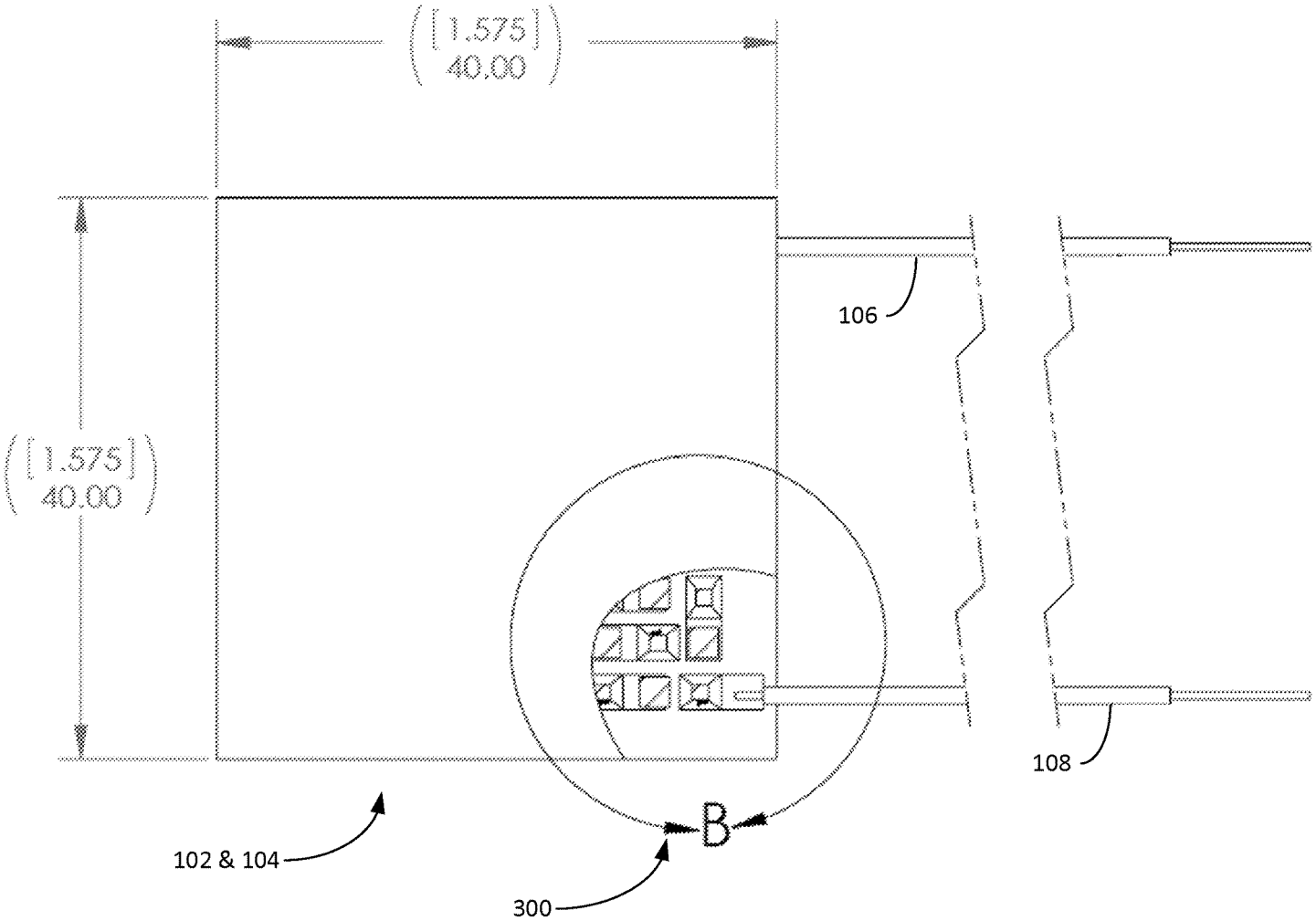
FIG. 2 illustrates a see-through view of a plate of thermo-electric system, according to some embodiments.

FIG. 2 illustrates a see-through top view of a plate of thermo-electric system, according to some embodiments. As shown, the interior of thermo-electric 100 comprises alternating trapezoid elements with increased figure of merit. Area B of alternating trapezoid elements 300 is shown as representative of other remaining interior portions not shown.

Figure 3:
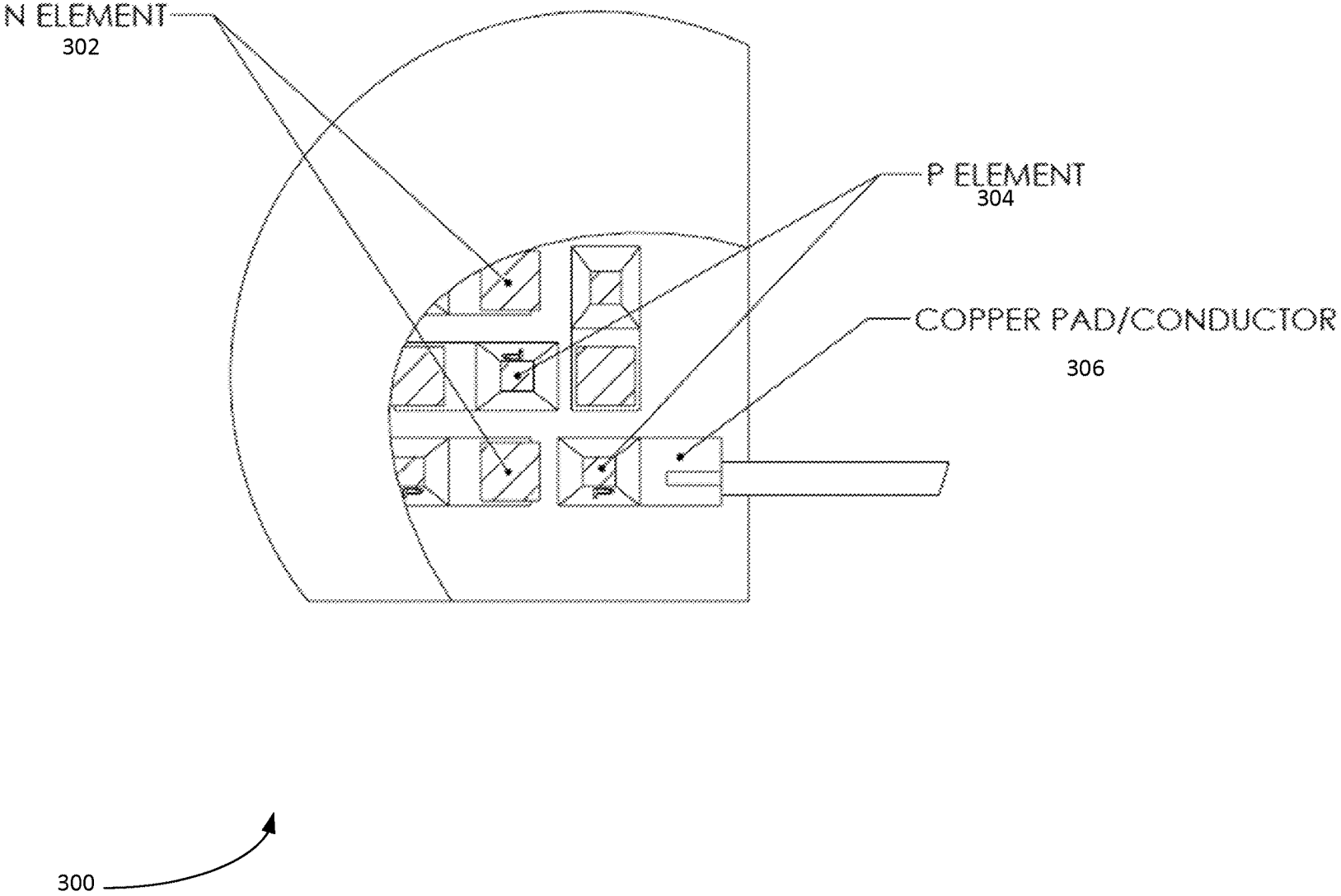
FIG. 3 illustrates a closeup top view of alternating trapezoid elements, according to some embodiments.

FIG. 3 illustrates a closeup top view of alternating trapezoid elements 300, according to some embodiments. As shown, trapezoid elements alternate between N-elements 302 and P-elements 304. A copper pad/conductor 306 is also provided as shown. N-elements 302 and P-elements 304 are trapezoidal in shape. N-elements 302 and P-elements 304 can be triangular in shape.

Figure 4:
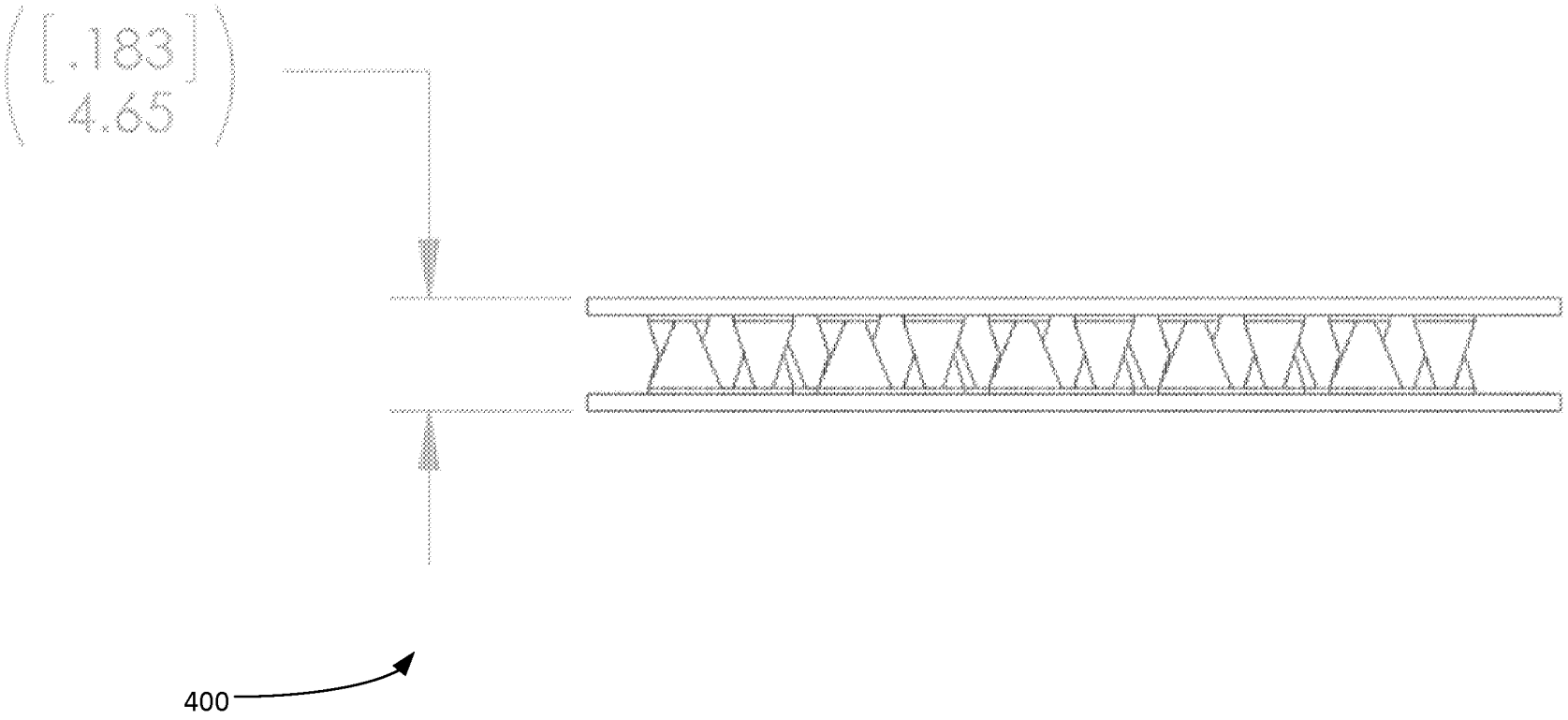
FIG. 4 illustrates a side view of alternating trapezoid elements, according to some embodiments.

FIG. 4 illustrates a side view 400 of alternating trapezoid elements, according to some embodiments. Top plate 104 and bottom plate 102 are also shown.

Figure 5:
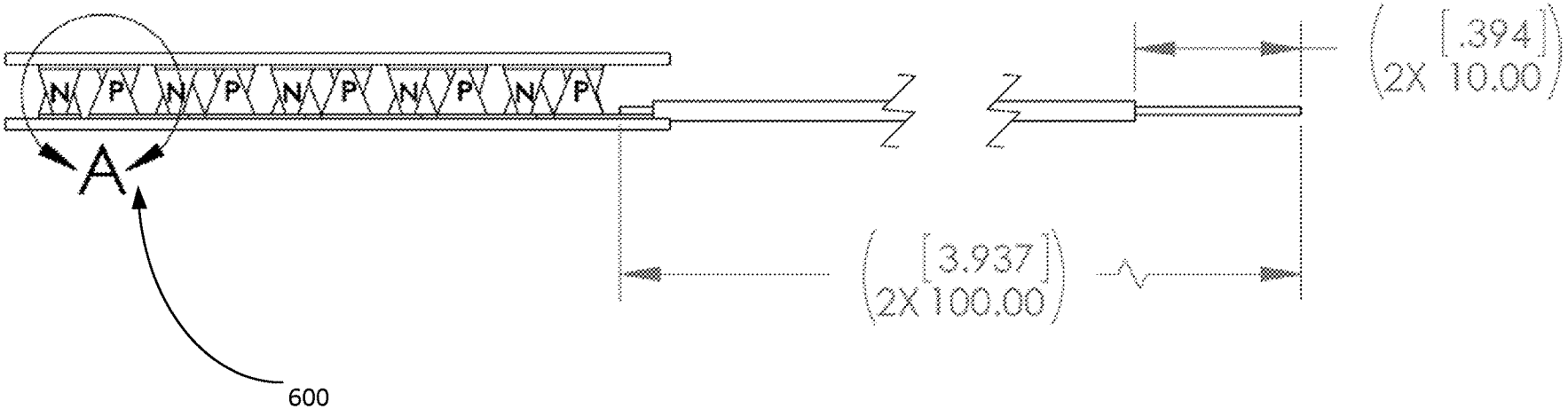
FIG. 5 illustrates a labelled side view of an alternating of trapezoid elements, according to some embodiments.

FIG. 5 illustrates a labelled side view 500 of an alternating of trapezoid elements, according to some embodiments. Labelled side view 500 illustrates labelled views of N-elements 302 and P-elements 304. Close up view A 600 is demarcated by way of example.

Figure 6:
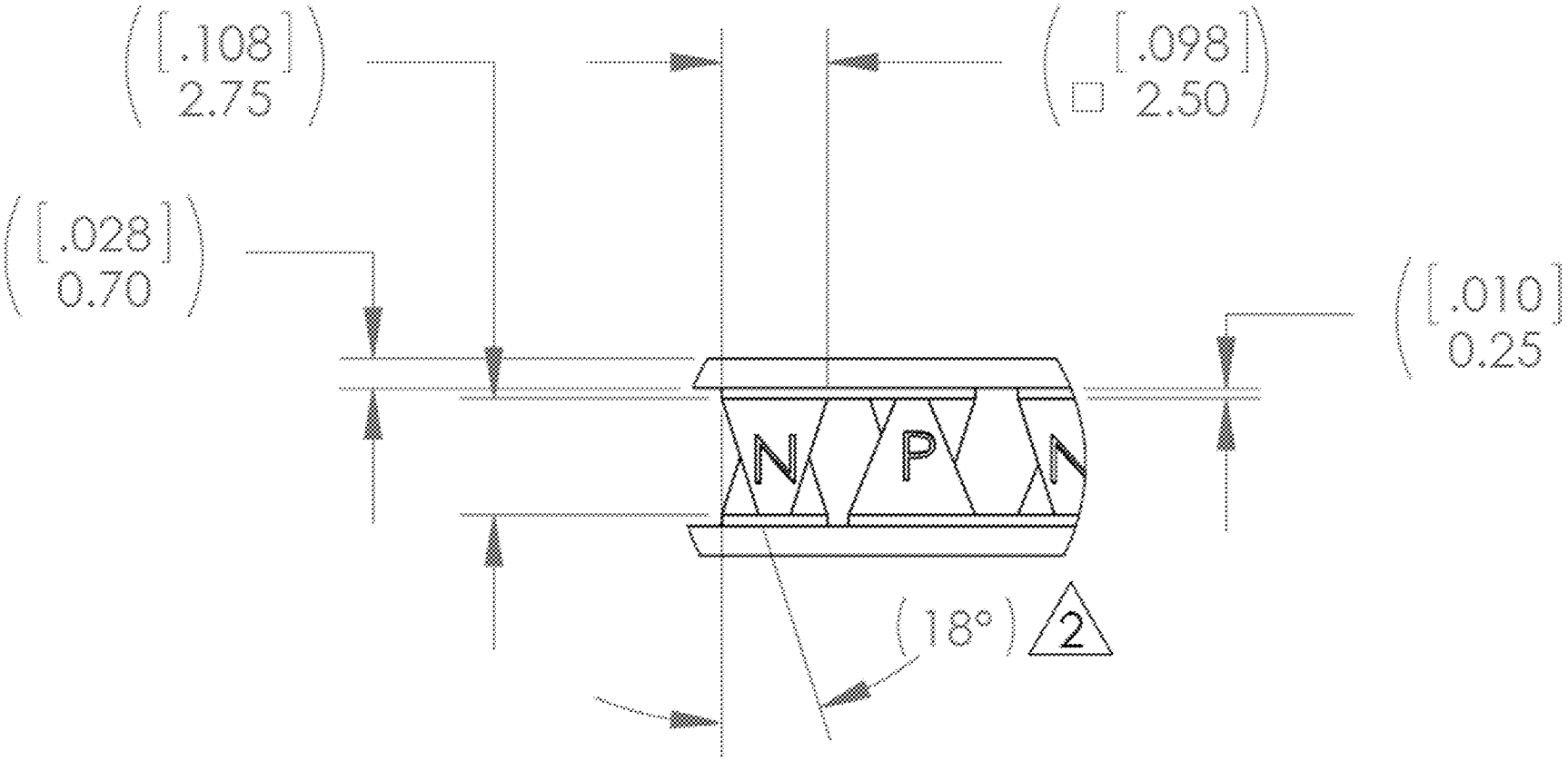
FIG. 6 illustrates a close-up view of the alternating of trapezoid elements, according to some embodiments.
Figure 7:
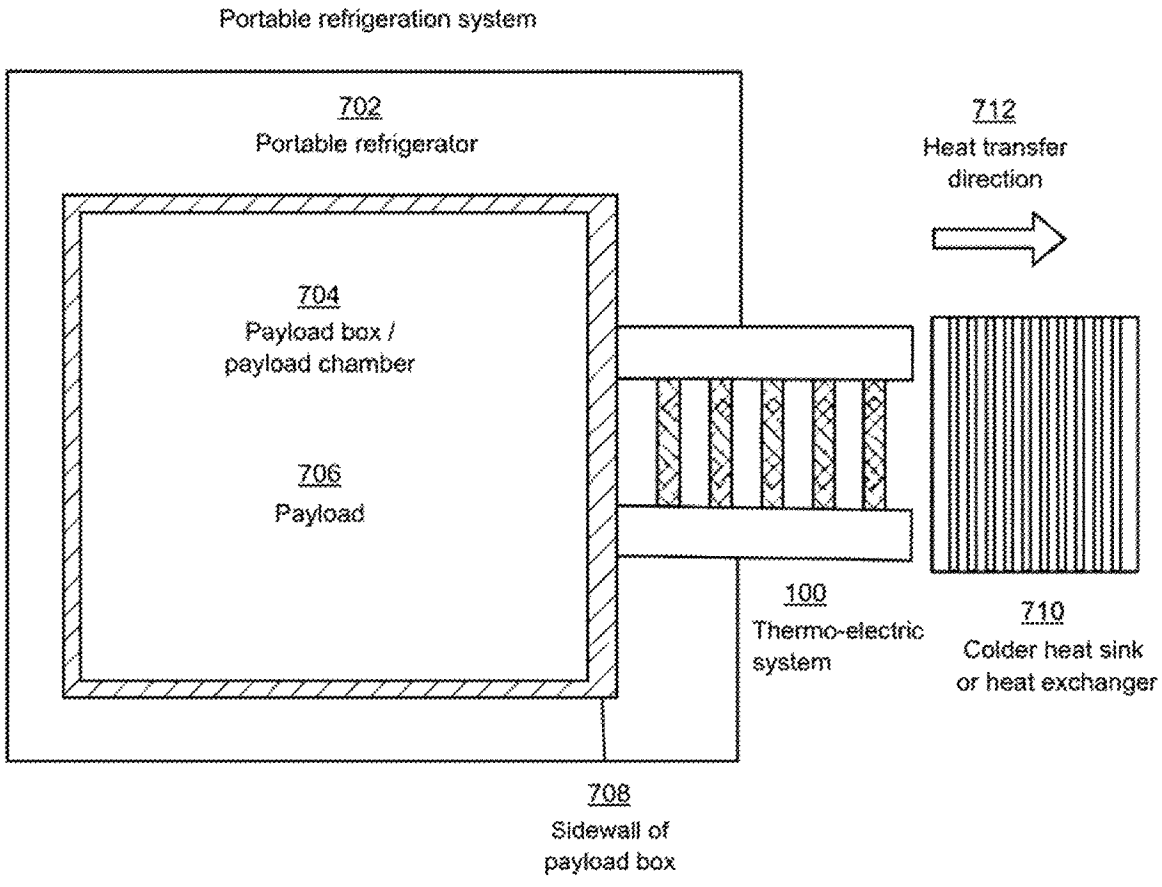

FIG. 6 illustrates a close-up view A 600 of the alternating of trapezoid elements, according to some embodiments. Close-up view A 600 further illustrates example size and scale values that are provided by way of example and not of limitation.

Conclusion

Although the present embodiments have been described with reference to specific example embodiments, various modifications and changes can be made to these embodiments without departing from the broader spirit and scope of the various embodiments. For example, the various devices, modules, etc. described herein can be enabled and operated using hardware circuitry, firmware, software or any combination of hardware, firmware, and software (e.g., embodied in a machine-readable medium).

In addition, it can be appreciated that the various operations, processes, and methods disclosed herein can be embodied in a machine-readable medium and/or a machine accessible medium compatible with a data processing system (e.g., a computer system), and can be performed in any order (e.g., including using means for achieving the various operations). Accordingly, the specification and drawings are to be regarded in an illustrative rather than a restrictive sense. In some embodiments, the machine-readable medium can be a non-transitory form of machine-readable medium.

What is claimed is:

1. A thermo-electric system with alternating trapezoid elements with increased figure of merit comprising:

a thermal spreader system comprising:

a top plate comprising at least one heat spreader material, a bottom plate comprising the at least one heat spreader material; and an interior portion of the thermo-electric system comprising an alternating arrangement of the trapezoid elements comprising a plurality of P-trapezoid elements and a plurality of N-trapezoid elements, wherein the top plate is forty (40) millimeters by forty (40) millimeters, wherein the bottom plate is forty (40) millimeters by forty (40) millimeters, wherein a thickness of the thermal spreader system is 4.65 millimeters, wherein a first row of the plurality of P-trapezoid elements and the plurality of N-trapezoid elements comprises a first P-trapezoid element coupled with a Positive Peltier wire via a first copper pad, wherein each P-trapezoid element alternates with each N-trapezoid element, wherein each basal surface of each P-trapezoid element has a larger surface than each top surface of each P-trapezoid element and a basal surface of each N-trapezoid element has a smaller area than each top surface of each N-trapezoid element, wherein the thermal spreader system is coupled with a Negative Peltier wire, wherein the thermal spreader system is coupled with the Positive Peltier wire, wherein a thickness of the top plate is 0.7 millimeters, wherein a thickness of the bottom plate is 0.7 millimeters, wherein a base length of each N-trapezoid element is 2.5 millimeters, wherein each basal surface of each P-trapezoid element is coupled with the bottom plate, wherein each basal surface of each N-trapezoid element is coupled with the top plate, wherein a sidewall of each N-type trapezoid element forms an angle of 18° relative to a line that is perpendicular to the top plate and the bottom plate, wherein the thermal spreader system is coupled with a side of a payload box that comprises aluminum of a portable refrigerator as a thermoelectric module, and wherein the thermal spreader system transfers energy as heat from the payload box of a portable refrigeration system to a colder heat sink or heat exchanger, wherein the aluminum is sprayed with a thermoplastic elastomer.

* * * * *